US006911901B2

(12) United States Patent
Bown

(10) Patent No.: US 6,911,901 B2
(45) Date of Patent: Jun. 28, 2005

(54) MULTI-FUNCTIONAL VIBRO-ACOUSTIC DEVICE

(75) Inventor: Russ Bown, East Sussex (GB)

(73) Assignee: New Transducers Limited, Cambridgeshire (GB)

( * ) Notice: Subject to any disclaimer, the term of this patent is extended or adjusted under 35 U.S.C. 154(b) by 580 days.

(21) Appl. No.: 10/022,837

(22) Filed: Dec. 20, 2001

(65) Prior Publication Data

US 2002/0075135 A1 Jun. 20, 2002

Related U.S. Application Data

(60) Provisional application No. 60/257,153, filed on Dec. 22, 2000.

(30) Foreign Application Priority Data

Dec. 20, 2000 (GB) ..... 0031246

(51) Int. Cl.[7] ..... G08B 1/00
(52) U.S. Cl. ..... 340/384.1; 345/168
(58) Field of Search ..... 341/22; 381/152, 381/335, 431, 396, 353; 200/5 A

(56) References Cited

U.S. PATENT DOCUMENTS

| | | | | |
|---|---|---|---|---|
| 4,554,419 A | | 11/1985 | King et al. | |
| 5,212,473 A | * | 5/1993 | Louis | 345/168 |
| 5,329,070 A | | 7/1994 | Knowles | |
| 5,412,189 A | | 5/1995 | Cragun | |
| 5,561,278 A | * | 10/1996 | Rutten | 200/5 A |
| 5,628,031 A | | 5/1997 | Kikinis et al. | |
| 5,856,820 A | | 1/1999 | Weigers et al. | |
| 5,977,867 A | | 11/1999 | Blouin | |
| 6,002,392 A | * | 12/1999 | Simon et al. | 345/702 |
| 6,118,435 A | | 9/2000 | Fujita et al. | |
| 6,332,029 B1 | | 12/2001 | Azima et al. | |
| 6,342,831 B1 | * | 1/2002 | Azima | 340/384.1 |

FOREIGN PATENT DOCUMENTS

| | | |
|---|---|---|
| DE | 43 23 863 A1 | 1/1995 |
| GB | 2 301 217 A | 11/1996 |
| WO | WO 97/09842 A2 | 3/1997 |
| WO | WO 97/09843 A1 | 3/1997 |
| WO | WO 97/09853 A2 | 3/1997 |
| WO | WO 00/02417 A1 | 1/2000 |
| WO | WO 00/54548 A2 | 9/2000 |
| WO | WO 01/31971 A2 | 5/2001 |
| WO | WO 01/48684 A2 | 7/2001 |

* cited by examiner

*Primary Examiner*—Michael Horabik
*Assistant Examiner*—Hung Dang
(74) *Attorney, Agent, or Firm*—Foley & Lardener LLP

(57) ABSTRACT

Multi-functional electro-acoustic apparatus has a bending wave panel loudspeaker, an input device (11) forming part of the surface of the bending wave panel (5), and means (13) for providing force feedback to the input device. An electro-acoustic transducer (15) attached to the bending wave panel excites bending waves in the panel to produce an acoustic output. The panel (5) provides several functions and may be considered to be a hyper-functional surface (HFS).

12 Claims, 3 Drawing Sheets

MULTI-FUNCTIONAL VIBRO-ACOUSTIC DEVICE

This application claims the benefit of provisional application Ser. No. 60/257,153, filed Dec. 22, 2000.

TECHNICAL FIELD

This invention relates to apparatus which combines a vibro-acoustic device with other sensors and additional functionality.

BACKGROUND ART

Bending wave or distributed mode loudspeakers (DML) are described in International application WO97/09842, U.S. Pat. No. 6,332,029 and other documents in the name New Transducers Ltd. Such loudspeakers may be used in applications where the loudspeaker element has additional functionality. For example, International applications WO97/09843, WO97/09853 and WO01/31971 describes the use of such panels as a ceiling tile, in a projection screen and in a keyboard, respectively.

Furthermore, applications of DML technology have extended to the use of both opaque and transparent loudspeaker panels incorporating touch-sensitive capability. For example, International application WO00/54548 describes electronic apparatus incorporating a loudspeaker having a bending wave panel member with a user-accessible surface, an electro-acoustic vibration exciter on the panel member to introduce bending wave energy into the panel member in response to an electrical signal applied thereto, and at least one touch-sensitive area on or associated with the user-accessible surface and responsive to user contact. International application WO01/48684 describes a contact-sensitive device comprising a transparent touch-sensitive plate mounted in front of a display device.

SUMMARY OF THE INVENTION

It is an object of the present invention to extend the use of acoustic radiating surfaces beyond touch sensitivity to include other sensory functions. The principle may be applied equally well to both bending wave loudspeakers (e.g. DML) as well as pistonic acoustic radiators.

According to the invention there is provided apparatus comprising a bending wave panel loudspeaker having a bending wave panel defining a surface and an electro-acoustic transducer attached to the bending wave panel to generate bending waves in the panel to produce an acoustic output, an input device forming part of the surface and means for providing force feedback to the input device.

Thus the apparatus combines loudspeaker and force feedback facility into the same surface. The transducer may excite the panel to cause it to emit sound at a variety of volumes. The volume of sound output may be adjusted via the input device depending on the application and thus provides a multi-functional loudspeaker. For example, the loudspeaker may be used in conference mode as a hands-free loudspeaker telephone or in telephone mode to be held to a user's ear. The panel may function as a ringer loudspeaker, as a vibration transducer for mobile telephones, pagers, etc., or as plural loudspeakers in a multi-channel player. The force feedback facility is otherwise known as haptics.

The input device may be a touch-sensitive input device or a keyboard. The means for providing force feedback may be in the form of a second transducer mounted to the panel which provides pulses to the panel. The pulses may be in the form of a transient spike signal whereby a button click sensation is provided. Alternatively, a single dual-function transducer may generate both acoustic output and force feedback. Alternatively, passive force feedback may be achieved by mounting the panel around its perimeter on nonlinearly deflecting panel mounts which provide the sensation of a button click when depressing a portion of the panel. Regions of the input device may be locally heated to provide tactile feedback.

The apparatus may comprise a visual display device associated with the bending wave panel. The visual display device may be in the form of a conventional display surface such as a liquid crystal display (LCD) panel. At least a part of the panel may be transparent and the visual display device may be mounted behind the transparent part of the panel and thus the panel may act as a transparent display window. Alternatively, the panel may also act as the display, for example by application of a light-emitting surface finish comprising light-emitting polymers or pigments. Thus, the number of components in the device may be reduced without loss of versatility or functionality.

Other functions may be provided. The panel may function as a microphone and/or loudspeaker. Alternatively, one or more microphones may be attached to the panel or the casing of the device. Any of the following items may be attached to the panel or the casing, namely a still or video camera, heating and/or cooling elements and a variety of other sensors, e.g. chemical composition, electrical sensors, light-meters, etc.

Chromatic characteristics may be included in the panel, such as passive chromatic finishes, e.g. anti-glare or mirrored finishes. Alternatively or additionally, active chromatics may be provided, such as photo-chromatics or thermo-chromatics. The panel may have surface textures and/or variable surface contours.

A wide range of acoustic and other sensory functions may be simultaneously integrated into the panel. Thus the panel may be termed a hyper-functional surface (HFS) since it is a single component assembly which may provide an increased number of functional synergies. The functions provided by the panel may be selected from the any one of the functions mentioned above. For example, by using a transparent, touch-sensitive panel with force feedback facility, apparatus may be obtained which may be used to view information, hear acoustic signals (messages, bleeps, clicks, etc.) and feel simulated button clicks through one's fingertips.

One advantage of the apparatus may be that by using a touch-sensitive panel the need for a separate keypad may be eliminated. This may be particularly useful in small electronic articles, for example hand-held devices, which have limited space for components. In certain applications (e.g. communications and computing), the size or bulk of devices and, hence, their internal volume in which individual components are housed is reducing and is tending toward zero. The usefulness of such devices may therefore be expressed in terms of their functionality per unit surface area. The invention anticipates this trend and offers a designer a way to maximise the range of sensory options for any given surface.

The apparatus according to the invention may reduce the surface area required to provide a plurality of functions. The invention may be considered to relate to the amalgamation of a vibro-acoustic device with other sensory features and functionality which results in significant benefits for the manufacture and use of such apparatuses which may be termed human machine interfaces (HMI).

Such multiple combinations would be more difficult using conventional loudspeakers. Mounting keypads, displays, etc. on the cone of a conventional loudspeaker is likely to interfere with the function of the cone.

BRIEF DESCRIPTION OF THE DRAWING

Embodiments that include the best mode for carrying out the invention will now be described, purely by way of example, with reference to the accompanying drawing, in which.

Figure 1:
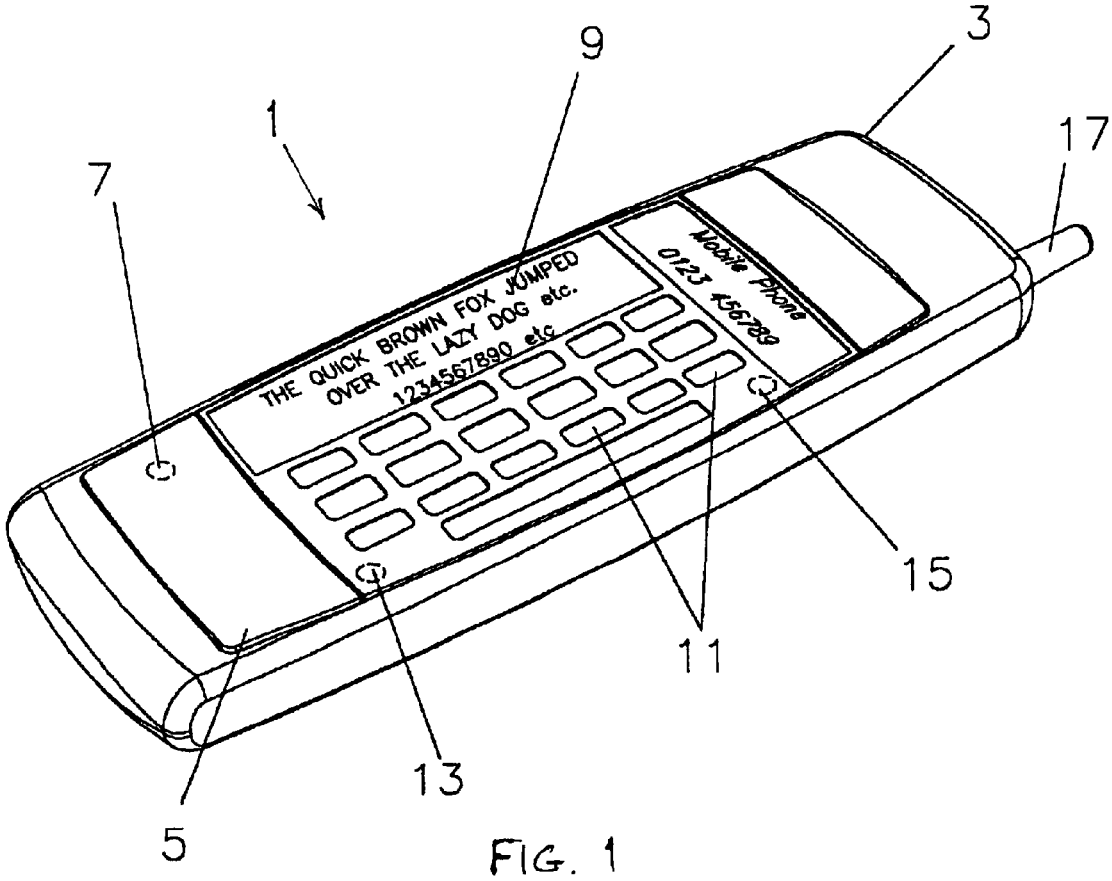
FIG. 1 is a perspective view of a personal data assistant (PDA) according to the invention.

It is to be understood that the invention is not limited in its application to the details of construction and the arrangement of components of preferred embodiments described below or illustrated in the drawing figures.

DETAILED DESCRIPTION

FIG. 1 shows apparatus according to the invention in the form of a smart-phone or personal data assistant (PDA) 1 having a casing 3 and an input device in the form of a touch-sensitive panel 5. The panel is of the appropriate thickness and moderate mechanical impedance to be set into bending wave vibration for several vibro-acoustic purposes. The panel is made from a transparent material allowing a liquid crystal display (LCD) 9 which is mounted behind the panel to be viewed.

The panel acts as a loudspeaker and is capable of supporting bending waves. A first transducer 15 is mounted to the panel to excite bending wave vibration in the panel to produce an acoustic output. The volume of the acoustic output may be adjusted allowing the PDA to be used in conference mode as a hands-free loudspeaker telephone or in telephone mode to be held to a user's ear.

A second exciter 13 is also mounted on the panel 5 to provide pulses to the panel when a key is depressed and hence provide haptics or tactile feedback. A single dual-function transducer may be provided which provides both the loudspeaker and feedback functionality. The dual function transducer, or either of the first and second transducers, may also be energisable in the body-perceived band around 80 Hz to provide silent signalling of a call. Thus, the panel acts as a multimode loudspeaker, for example, as a telephone ear piece, a hands-free speaker or a ringer.

The panel 5 also functions as a keypad or keyboard. Individual keys 11 of the keypad may appear on the display mounted underneath the panel or alternatively the keys may be marked on its surface. A microphone transducer 7 is also fixed to the panel whereby the panel may function as a microphone. Alternatively, one or more microphones may attached to the panel or the casing, allowing sound capture and localisation for sound reproduction when in conference or video mode.

A mobile communications aerial 17 and associated conventional mobile telephony circuitry (not shown) allows the device to function as a mobile telephone or to send and receive messages or video material. Images may be captured using a video camera attached to the panel or the casing.

As outlined above the panel provides several functions and may be considered to be a hyper-functional surface (HFS). The apparatus has a simple construction and performs the function of many distinct devices each of which use the panel (as HFS) as a user's main interface medium.

Figure 2:
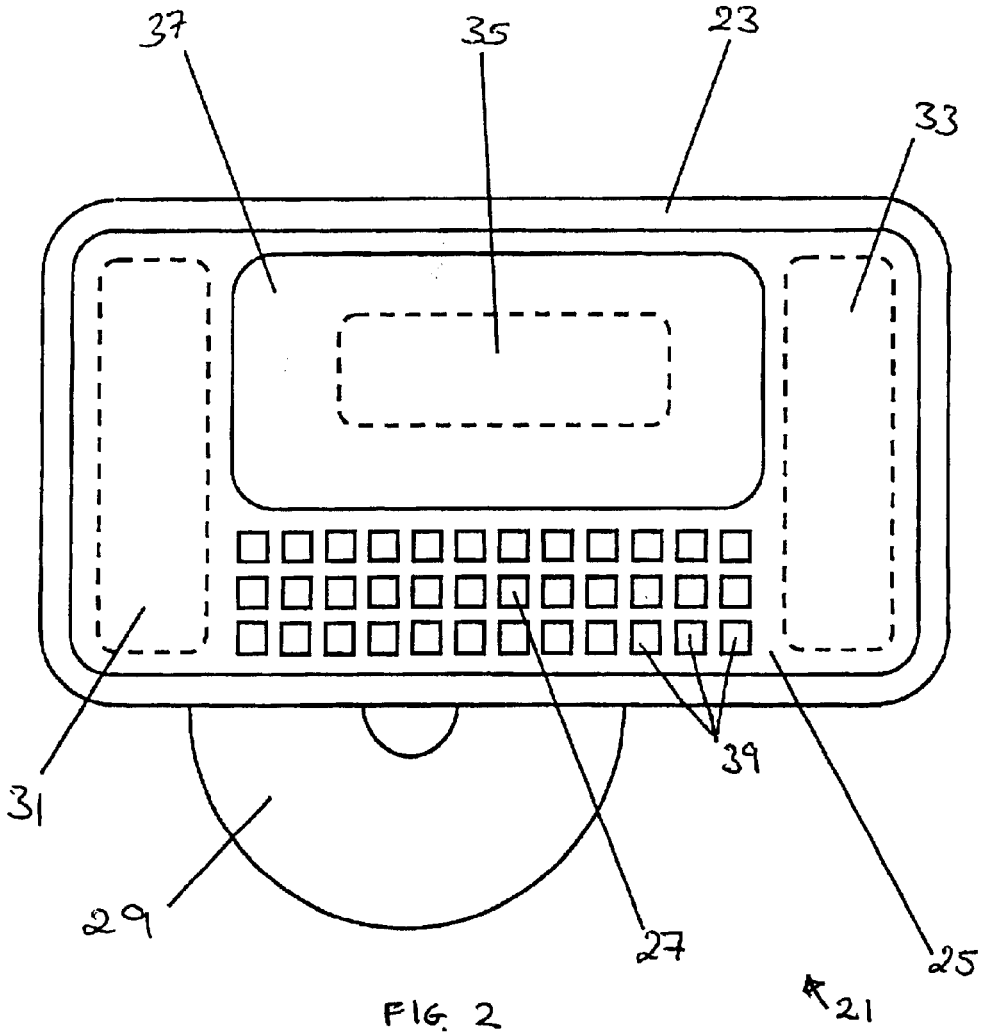
FIG. 2 is a schematic top plan view of a hand-held multi-channel player according to the invention.

FIG. 2 shows an alternative apparatus according to the invention in the form of a hand-held multi-channel player 21 having a casing 23 and a panel 25. The panel 25 is divided into several regions each providing separate functions, for example loudspeaker, input and/or display functions.

The panel has three loudspeaker regions which provide left, right and centre channels 31, 33, 35, respectively. At least one transducer (not shown) is mounted to each panel region to excite bending wave vibration in the panel to produce an acoustic output. When a disc 29 is inserted into the player 21 as indicated, the panel 25 may reproduce multi-channel (e.g. stereophonic) information stored on the disc.

A video display area 37 is mounted behind a transparent region of the panel 25. The display area 37 may display information from the disc 29 or alternatively may display information inputted to the device by a user on a keyboard region 27 of the panel 25. The keyboard region 27 includes several keys 39 marked on the surface of the panel 25. The keys 39 are configured to provide haptics or tactile feedback, for example by providing a transducer as described in FIG. 1. Alternatively, haptics or tactile feedback may be provided in either the apparatus of FIG. 1 or FIG. 2 by the mechanism shown in FIG. 3.

Figure 3:
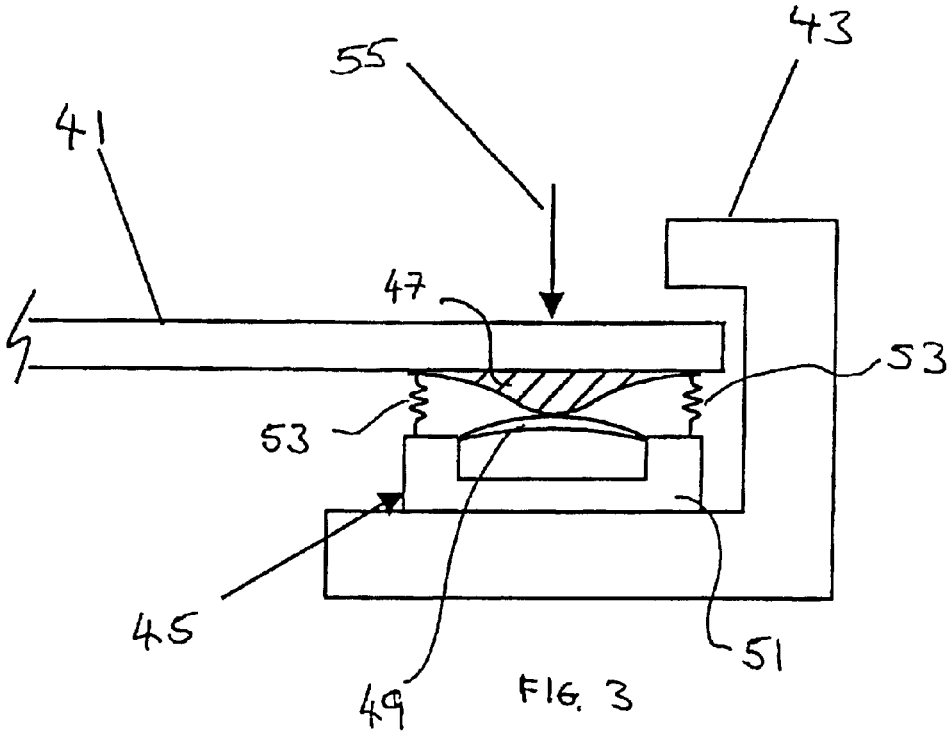
FIG. 3 is a cross-sectional view of a section of a keyboard which may be used in either the personal data assistant of FIG. 1 or the hand-held player of FIG. 2.

In FIG. 3, a panel 41 is mounted around its perimeter by mechanical reflex elements 45 to a frame 43 having a generally L-shaped cross section. The reflex elements are similar to those used in keyboards. Each mechanical reflex element 45 (only one is shown) comprises an upper pad 47 mounted to the panel 41 and a lower pad 49 touching the upper pad 47, the lower pad 49 being mounted on a mounting block 51 which is attached to the frame 43. The upper and lower pads 47, 49 are both dome-shaped and made of flexible material. A pair of springs 53 also connects the mounting block 51 to the panel 41. The deflection of the pads 47, 49 in conjunction with the rest of the reflex element 45 is non-linear. The reflex elements 45 are spaced such that, taking panel bending stiffness into account, unambiguous activation (deflection) of at least one reflex element is ensured. Since the reflex elements are designed to provide tactile feedback, it is important that at least one reflex element local to the point of application of force be activated.

When a user exerts pressure on the panel 41 in the direction of the arrow 55, at least some of the mechanical reflex elements 45 are compressed and, due to the resilient and non-linear nature of the elements, a return force is exerted on the panel 41 which is sensed by the user. Thus, force feedback and a sensation of a button click is provided when a portion of the panel is pressed or engaged.

Figure 4:
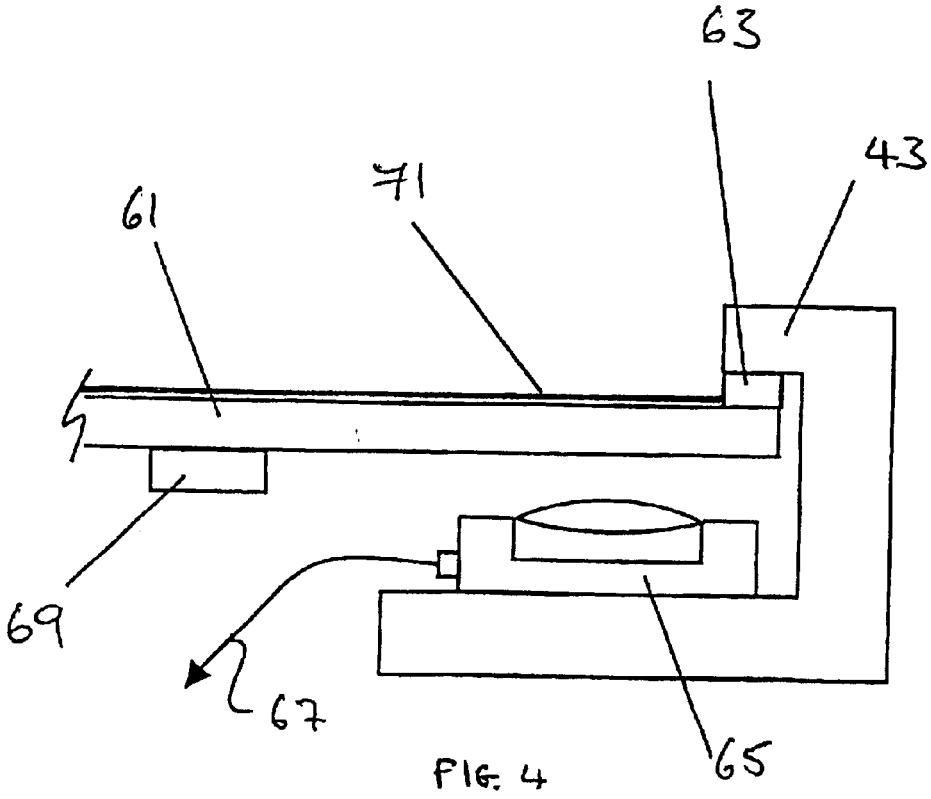
FIG. 4 is a cross-sectional view of a section of an alternative keyboard which may be used in either the personal data assistant of FIG. 1 or the hand-held player of FIG. 2.

FIG. 4 shows a panel 61 which may be the panel of apparatus shown in FIG. 1 or FIG. 2. The panel 61 is mounted in a frame 43 by means of a suspension 63 which extends around the perimeter of the panel 61. The suspension 63 may be resilient. The suspension 63 may wholly or partially clamp the panel 61. The frame 43 has a generally L-shaped cross section. An image module 65, for example a charge coupled device (CCD) image module, is mounted on the frame 43 behind the panel 61 whereby the image module 65 is integrated into apparatus according to the invention. The image module 65 captures still or video images and is connected to an image processor (not shown) by wires 67.

As in the apparatus of FIG. 1, haptics is provided by a transducer 69 mounted to the panel 61. The transducer 69 excites bending waves in the panel 61 to provide pulses to the panel 61 when a key is depressed. The panel optionally comprises chromatic characteristics in the form of a semi-reflecting chromatic layer 71.

It will be appreciated that the apparatus shown may be adapted to function as a computer, communicator, web TV, videophone, camcorder, dictaphone, organiser, augmented reality window, GPS/navigator, game and/or wearable fashion accessory. The apparatus may further comprise viewing apparatus for 3-D image perception or additional sound sources for reproducing extra audio channels, e.g. rear channels and a sub-woofer.

The invention may be considered to unlock a large number of new device options which may be expressed as the total number of combinations of each of the separate sensory functions in conjunction with any or all of the other functions. By adapting the combination of functions, the invention may have application in each of the following fields:

a) control surfaces in all consumer/industrial applications (including displays or product housings);

b) telephones, including mobile or fixed telephones, intercoms, pagers, or videophones;

c) multimedia devices, including laptops or personal data assistants (PDAs);

d) electronic goods, including portable music or video players and recorders, dictaphones, toys, games, cameras, video cameras, televisions, 3D televisions, virtual reality devices, augmented reality devices or video-on-demand devices;

e) other goods, e.g. white or brown goods, medical devices, clothing, badges, labelling, novelty and greetings products, credit cards or smart cards;

f) in architectural applications, e.g. furniture or office equipment;

g) in other applications, e.g. art or defence.

Various modifications will be apparent to those skilled in the art without departing from the scope of the invention, which is defined by the appended claims.

What is claimed is:

1. Apparatus comprising a bending wave panel loudspeaker having a bending wave panel defining a surface and an electro-acoustic transducer attached to the bending wave panel to excite bending waves in the panel to produce an acoustic output, a touch-sensitive input device forming part of the surface and means for providing force feedback to the input device, wherein the transducer generates both acoustic output and force feedback, the force feedback being in the form of pulses to the panel, wherein the pulses are in the form of a transient spike signal whereby a button click sensation is provided.

2. Apparatus according to claim 1, wherein the means for providing force feedback is in the form of non-linearly deflecting panel mounts by which the panel is mounted to the apparatus, the mounts producing a sensation of a button click when a portion of the panel is pressed.

3. Apparatus according to any one of claims 1 and 2, wherein regions of the input device are locally heated to provide tactile feedback.

4. Apparatus according to claim 1, comprising a visual display device associated with the bending wave panel.

5. Apparatus according to claim 4, wherein at least a part of the panel is transparent and the visual display device is mounted behind the transparent part of the panel.

6. Apparatus according to claim 4, wherein the panel comprises an integral visual display device.

7. Apparatus according to any one of claims 1, 2 and 4, wherein the panel also functions as a microphone.

8. Apparatus according to any one of claims 1, 2 and 4, comprising a still or video camera located behind the panel.

9. Apparatus according to claim 1, wherein the panel comprises chromatic characteristics.

10. Apparatus according to claim 1, wherein the acoustic output of the loudspeaker is adjustable via the input device.

11. Apparatus according to claim 1 in the form of a multi-channel player, wherein the panel has a plurality of loudspeaker regions for producing multi-channel sound.

12. Apparatus according to claim 11, comprising a keyboard on the panel surface.

* * * * *